United States Patent [19]

Green et al.

[11] Patent Number: 4,748,988

[45] Date of Patent: Jun. 7, 1988

[54] WEAR MONITORING

[75] Inventors: Robert J. Green; Michael V. Kumar, both of London, England

[73] Assignee: Molins PLC, Milton Keynes, England

[21] Appl. No.: 515,241

[22] Filed: Jul. 19, 1983

[30] Foreign Application Priority Data

Jul. 31, 1982 [GB] United Kingdom ..... 8222141

[51] Int. Cl.[4] ..... A21C 5/00; B07C 5/34; B65B 19/30

[52] U.S. Cl. ..... 131/280; 131/283; 131/84.1; 131/84.4; 209/535; 73/7

[58] Field of Search ..... 131/280, 283, 84.1, 131/84.4; 53/148, 534; 209/535-537; 73/7

[56] References Cited

U.S. PATENT DOCUMENTS 4,210,159 7/1980 Quarenghi ..... 131/84.3

4,236,534 12/1980 Heitmann et al. ..... 131/84.3

4,276,891 7/1981 Dyett et al. ..... 131/84.3

4,373,806 2/1983 Tipper ..... 356/23

*Primary Examiner*—V. Millin

*Attorney, Agent, or Firm*—John C. Smith, Jr.

[57] ABSTRACT

A method and apparatus for monitoring wear associated with a particular cyclically moving part in a machine, the machine comprising a plurality of moving parts and operating in a succession of cycles. Apparatus is provided for generating a first signal at a predetermined position and direction of movement of the moving part, for generating a second signal at a predetermined cyclic position in each machine cycle, for producing a third signal indicative of the interval of time between the first signal and the second signal, and for forming a comparison with a reference signal to determine the extent of wear associated with the particular moving part.

19 Claims, 4 Drawing Sheets t1 t2 t4 t6 t7 t9 t11 t12
T t3 t5 t8 t10 t2 t4 t10 t11 t5 t8 t1 t4 t8 t11

WEAR MONITORING

This invention relates to a method and apparatus for monitoring wear.

In machines of the tobacco industry, particularly cigarette packaging machines, there are many intermittently operating mechanisms where a first member has to complete a rapid cyclic movement in close proximity with a second co-operating member before the second member executes its own movement. A loss of synchronism between such members (which in practice will be mainly due to progressive wear) may cause extensive damage, and additionally result in considerable lost production.

An object of this invention is to monitor the wear which occurs in such a cyclically moving part of a machine.

According to a first aspect of the invention there is provided, in a machine of the tobacco industry which operates in a succession of machine cycles, a method of monitoring wear associated with a first cyclically moving part, comprising the steps of generating a first signal at a predetermined position and direction of movement of said moving part; generating a second signal at a predetermined cyclic position in each machine cycle; producing a third signal indicative of the time interval between the first signal and the second signal; and processing the third signal, including forming a comparison with a reference signal to determine the extent of wear associated with the first moving part.

The first and second signals are preferably clearly defined transitions between two possible states and the time interval between the signals may be measured from the first to the second or vice versa. As the first moving part wears the time interval will either decrease or increase and such changes are detected by forming a suitable comparison with the reference signal.

In a preferred arrangement the reference signal varies inversely with the speed of the machine and the third signal is directly compared with said reference signal. Therefore, the third signal and the reference signal may both be arranged to vary with speed such that the difference between the two said signals is indicative of wear in the first moving part.

In an alternative arrangement a quotient is formed between the third signal and a complement of the third signal, and said quotient is compared with the reference signal which is pre-set and does not vary with the speed of the machine. The complement of the third signal is a signal indicative of the time interval which remains when a first time interval between the first signal and the second signal is subtracted from the interval of time corresponding to a full machine cycle containing said first time interval.

The third signal may be an analogue signal the amplitude of which increases linearly over said time interval. However, in the preferred arrangement the third signal is indicative of a count of pulses generated over said time interval.

In many arrangements the first cyclically moving part cooperates with a second cyclically moving part which does not wear to the same extent as the first moving part. In such arrangements the second signal may be generated at a predetermined position of the second moving part.

One mechanism on a cigarette packaging machine which is prone to wear is that operating a plunger which transfers a cigarette bundle (partly enclosed in a soft pack) from an arbor drum to a drying drum.

According to a second aspect of the invention, there is provided, in a machine of the tobacco industry which operates in a succession of machine cycles, apparatus for monitoring wear associated with a first cyclically moving part, comprising a device for generating a first signal at a predetermined position and direction of movement of said moving part; a device for generating a second signal at a predetermined cyclic position in each machine cycle; means for producing a third signal indicative of the interval of time between the first signal and the second signal; and processing means including means for forming a comparison with a reference signal to determine the extent of wear associated with the first moving part.

Preferably each of said devices produces a signal by means of an output which switches between two possible states at said predetermined positions of the first moving part or the machine cycle respectively. The devices may consist of a light emitter and a light detector arranged so that said detector receives light from said emitter at predetermined positions of the respective moving parts.

The invention may be extended to monitor a plurality of moving parts. Accordingly a third aspect of the invention provides, in a machine of the tobacco industry, or a plurality of such machines, apparatus for monitoring wear associated with a plurality of first moving parts, comprising a plurality of devices in which each of said first moving parts has a device for generating a first signal at a predetermined position and direction of movement of the respective moving part, and a device for generating a second signal at a predetermined cyclic position in each machine cycle; a first multiplexer for sequentially selecting said first signals; means for producing a third signal indicative of the interval of time between the selected first signal and the second signal; and processing means including means for forming a comparison with a reference signal to sequentially determine the extent of wear associated with each of the first moving parts.

Preferably the apparatus further includes a plurality of devices for producing a separate second signal for each of the first signals; and a second multiplexer for selecting the second signal associated with the selected first signal.

The invention will now be described, by way of example only, with reference to the accompanying drawings in which.

Figure 1:
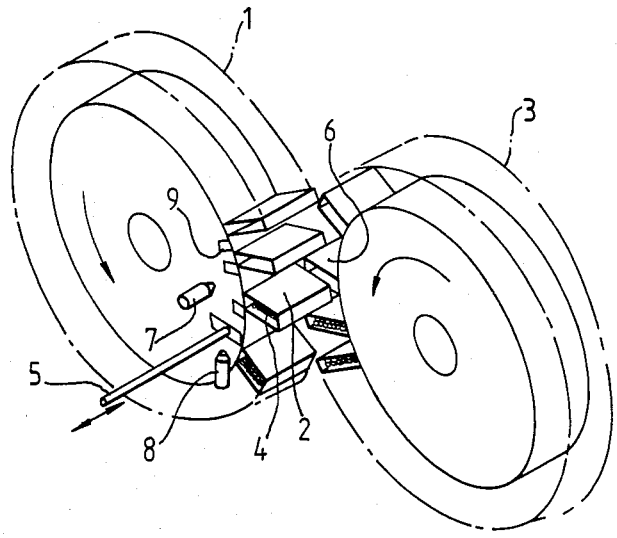
FIG. 1 shows part of a packing machine embodying the invention.

Part of a machine for packing bundles of cigarettes in so-called soft packs is shown in FIG. 1. Cigarette packets are partially formed on an arbor drum 1 having a plurality of arbors 2 and are then individually transferred to a drying drum 3. A cigarette bundle 4 is held in each arbor 2 and is transferred with its surrounding packet by a plunger 5 into a pocket 6 of the drying drum 3. During each machine cycle, which lasts from the completion of transfer of one packet to that of the next packet, the arbor drum 1 and the drying drum 3 index one step in opposite directions until the next arbor 2 is aligned with the next pocket 6. Once aligned the drums stop rotating for a short interval (termed the dwell period) during which the plunger 5 pushes the partially assembled packet into the aligned pocket 6 and then retracts so that the machine cycle may be repeated.

Over a long period of operation the mechanism of the plunger 5 is liable to wear, resulting in the plunger being slightly slow to retract once a packet has been transferred. If the wear becomes excessive, and worn parts were not replaced, the plunger would eventually be trapped by the rotating arbor drum. In order to detect such wear before serious damage to the mechanism of the plunger occurs, the position of the plunger is monitored and compared with a reference signal occuring at a predetermined position within the machine cycle. The mechanism of the arbor drum does not wear to the same extent as that of the plunger and therefore a signal indicative of the position of the arbor drum provides a suitable reference signal.

The position of the arbor drum is monitored by a detector 7 which is connected by a fibre cable (not shown) to a light source. Light emitted by the detector is intermittently reflected, depending on the position of the arbor drum, by reflective marks 9 back to the detector 7. Light reflected in this way is transmitted to a drum transducer D1, by a second fibre optic cable, which produces an electrical high or low signal indicative of the position of the arbor drum. A similar arrangement for the plunger 5 has a plunger transducer P1 which produces an electrical high or low signal indicative of the position of the plunger. In an alternative arrangement a detector may consist of two separate units aligned on opposite sides of a moving part such that the moving part intermittently blocks the light path between the units.

Figures 2A, 2B, 2C, 2D, 2E:
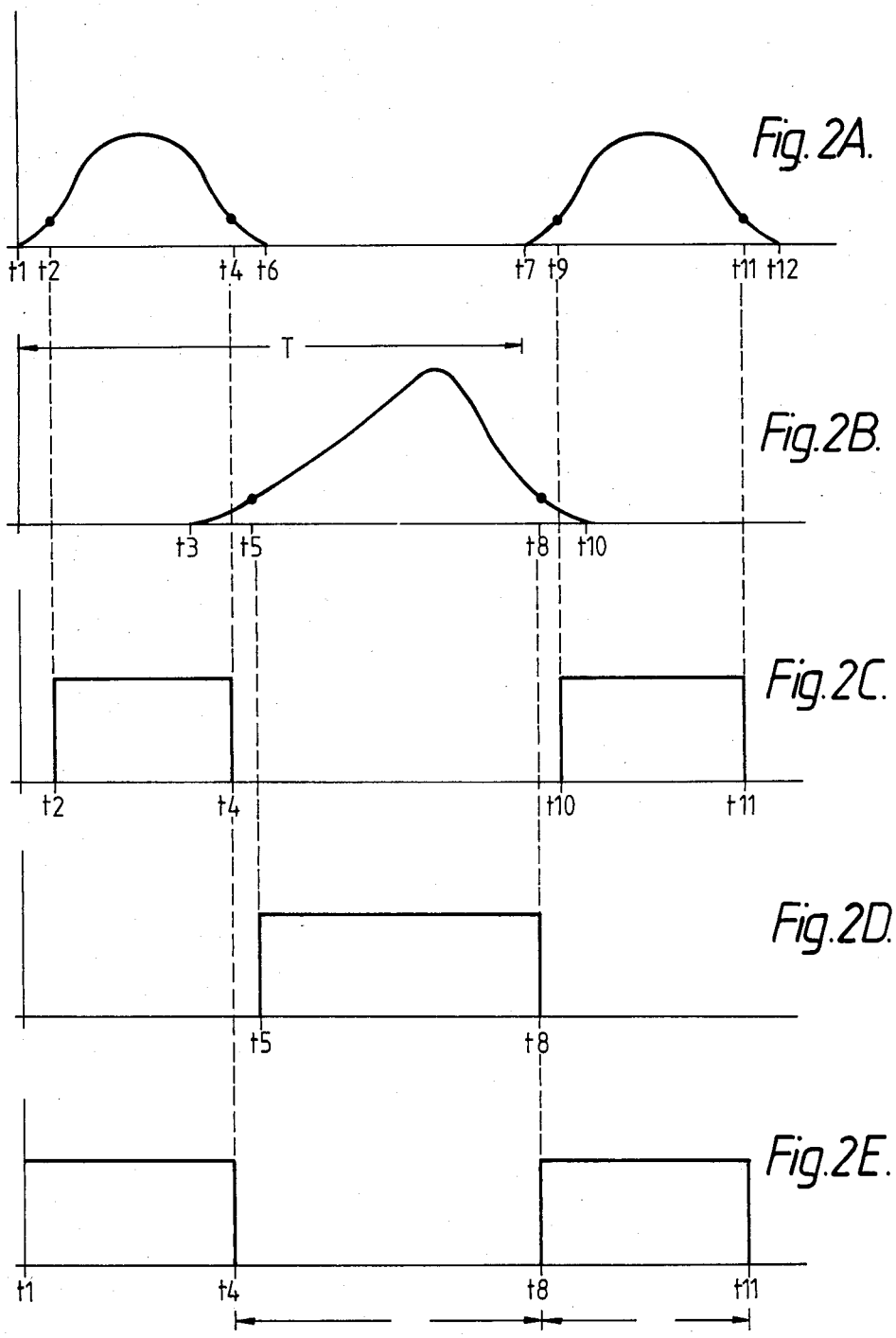
FIGS. 2A to 2E are displacement and signal output diagrams, all against a common time base, for two intermittently moving members of FIG. 1.

FIG. 2A shows a displacement/time graph for the indexable arbor drum 1, in which the interval from time t1 to time t7 is one full machine cycle T, and the interval from time t6 to t7 is the dwell period. The signal obtained from the associated transducer D1 is shown in FIG. 2C. The detector 7 is positioned so that at each indexing movement a mark 9 on the abor drum 1 makes the output of the transducer D1 go high at time t2 (after the drum starts rotating) and the absence of a mark makes the output go low at time t4 (before the drum stops rotating).

FIG. 2B is a displacement/time graph for the plunger 5 (plotted on the same time axis as FIG. 2A) with the output of its associated transducer P1 shown in FIG. 2D. As shown by the slope of the plot in FIG. 2B, the plunger 5 moves at a slower speed on the outward stroke when pushing the cigarette bundle 2 than on the return stroke thus reducing damage to the cigarettes.

The output of the transducer P1 is arranged to go high at time t5 (just after the plunger 5 starts moving) and low at time t8 (just before the plunger comes to rest). These are instants at which the plunger traverses past the detector 8 on the outward and return strokes respectively.

Figure 3:
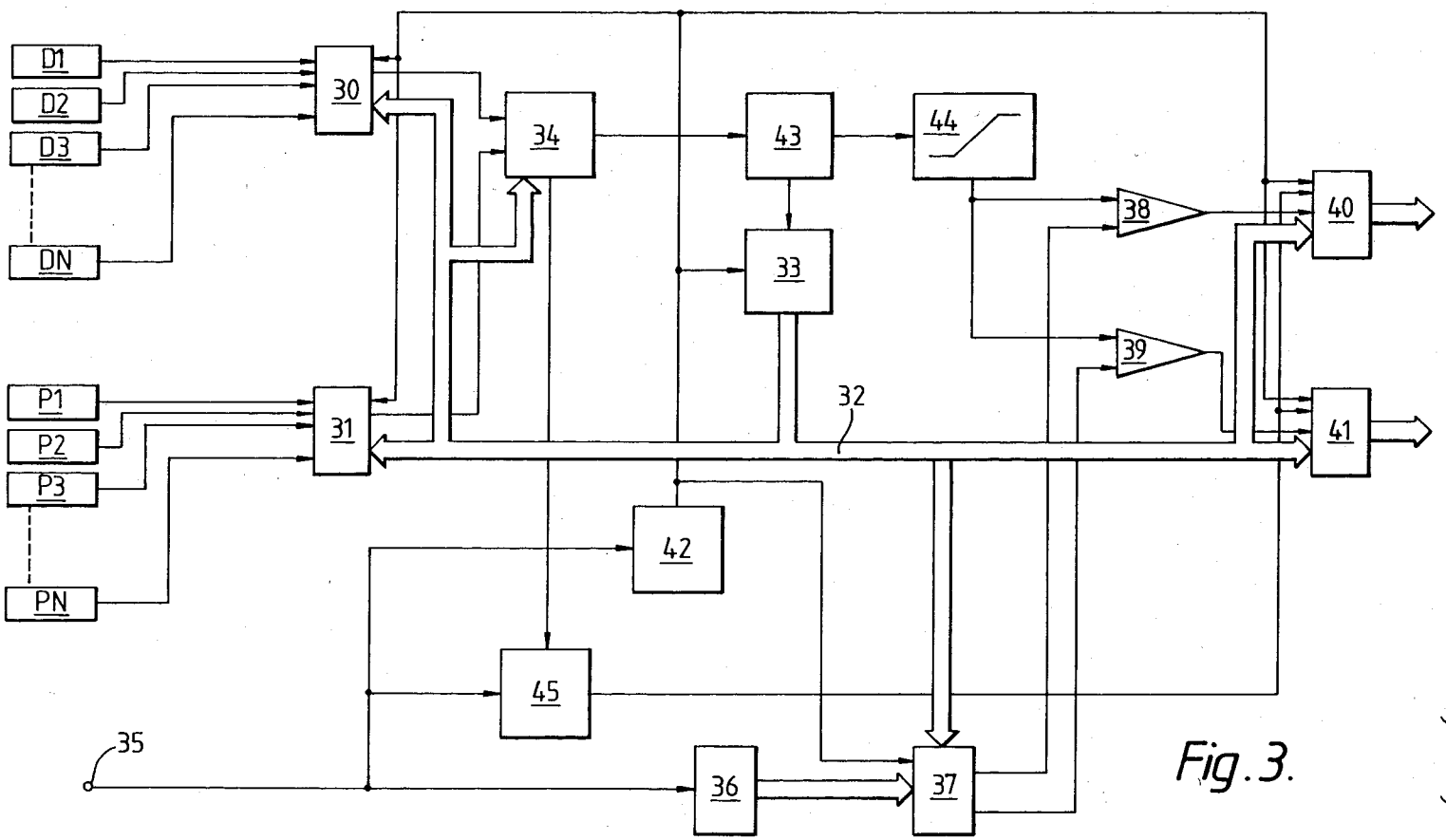
FIG. 3 is a block diagram of an analogue circuit for use with FIG. 1.

A block diagram of an analogue circuit suitable for processing the output from each transducer D1 and P1 is shown in FIG. 3.

The circuit is designed to process the outputs from a plurality of transducer combinations, i.e. transducers D1 to Dn and P1 to Pn; transducers having the same numeral are associated with co-operating moving parts. The outputs from the D1 to Dn transducers are applied to a channel select multiplexer 30, and the outputs from the P1 to Pn transducers are applied to a similar channel select multiplexer 31. A binary-coded-decimal (BCD) code is applied to each multiplexer on a channel select bus 32 from a channel select circuit 33 which sequentially selects outputs from the co-operating pairs of transducers (for example D1 and P1, then D2 and P2 etc.). The transducer outputs are applied to a logic circuit 34 which produces an output signal as shown in FIG. 2E for each co-operating transducer pair.

The logic circuit 34 is arranged to produce an output which goes low at time t4 (FIG. 2E) for an interval T1 and high at time t8 for an interval T2.

Progressive wear associated with the mechanism of the plunger 5 results in the plunger being slow to retract once a cigarette bundle has been transferred to a pocket 6 of the drying drum 3. This results in the output from the plunger transducer P1 (and therefore the output from the logic circuit 34) being delayed slightly from going high at time t8. The wear monitoring circuit is therefore required to measure slight increases in the interval T1 with reference to the operating speed of the machine. The analogue circuit shown in FIG. 3 achieves this by generating a voltage which is proportional to the interval T1, and comparing this with a voltage which is inversely proportional to the speed of the machine.

A. d.c. voltage inversely proportional to the speed of the machine (termed a voltage feed-back signal) is applied to an input 35 to a bias circuit 36. The bias circuit 61 produces a biased feed-back signal separately scaled to suit each channel each of which may be adjusted independently while setting-up the apparatus. The separately scaled feed-back signals are applied to a speed reference multiplexer 37 which is controlled by the channel select bus 32. The scaled feedback signals selected by the multiplexer 37 are sequentially compared by two comparators 38 and 39 with a voltage corresponding to the wear present in the respective mechanisms. The output signals from the comparators are de-multiplexed by output multiplexers 40 and 41; these are bilateral integrated circuits identical to the channel select multiplexers 30, 31 and controlled by the same channel select circuit 33.

The voltage feed-back signal is also applied to a threshold detector 42, which applies an enabling signal to the channel select multiplexers 30 and 31, to the speed reference multiplexer 37, and to the output multiplexers 40 and 41 once a preset speed threshold of the machine has been reached. This enabling signal also resets the channel select circuit 33 which then produces a channel code on the channel select bus 48 corresponding to the first transducer pair D1 and P1. The logic circuit 34 produces a signal (as shown in FIG. 2E) derived from the output signals of the transducers D1 and P1, to a channel select control circuit 43. This circuit waits for the leading edge of interval T1, and then enables a ramp generating circuit 44 which generates a linearly increasing voltage ramp over the interval T1. The voltage ramp is continuously compared by the two comparators 38 and 39 with the associated speed reference signal from the speed reference multiplexer 37. An output from a comparator is produced when the output of the ramp generator 44 exceeds the speed reference signal, the two comparators having different speed reference levels so that different levels of wear can be detected and the necessary action taken.

At the end of the interval T1 the control circuit 43 applies a signal to the channel select circuit 33 which changes the channel code by one increment so that the derived output from the next cooperating pair of transducers (D2 and P2) is compared with the respective speed reference signal as above. After examining the output from all the transducers up to Dn and Pn the first transducer pair is examined again and the process repeated.

The system is also required to detect speed changes occuring within the interval T1 which would produce spurious results. This is achieved by a speed change detection circuit 45 which receives the voltage feedback signal and applies a disabling signal to the output multiplexers 40 and 41 if the speed of the machine substantially changes over the internal T1.

Figure 4:
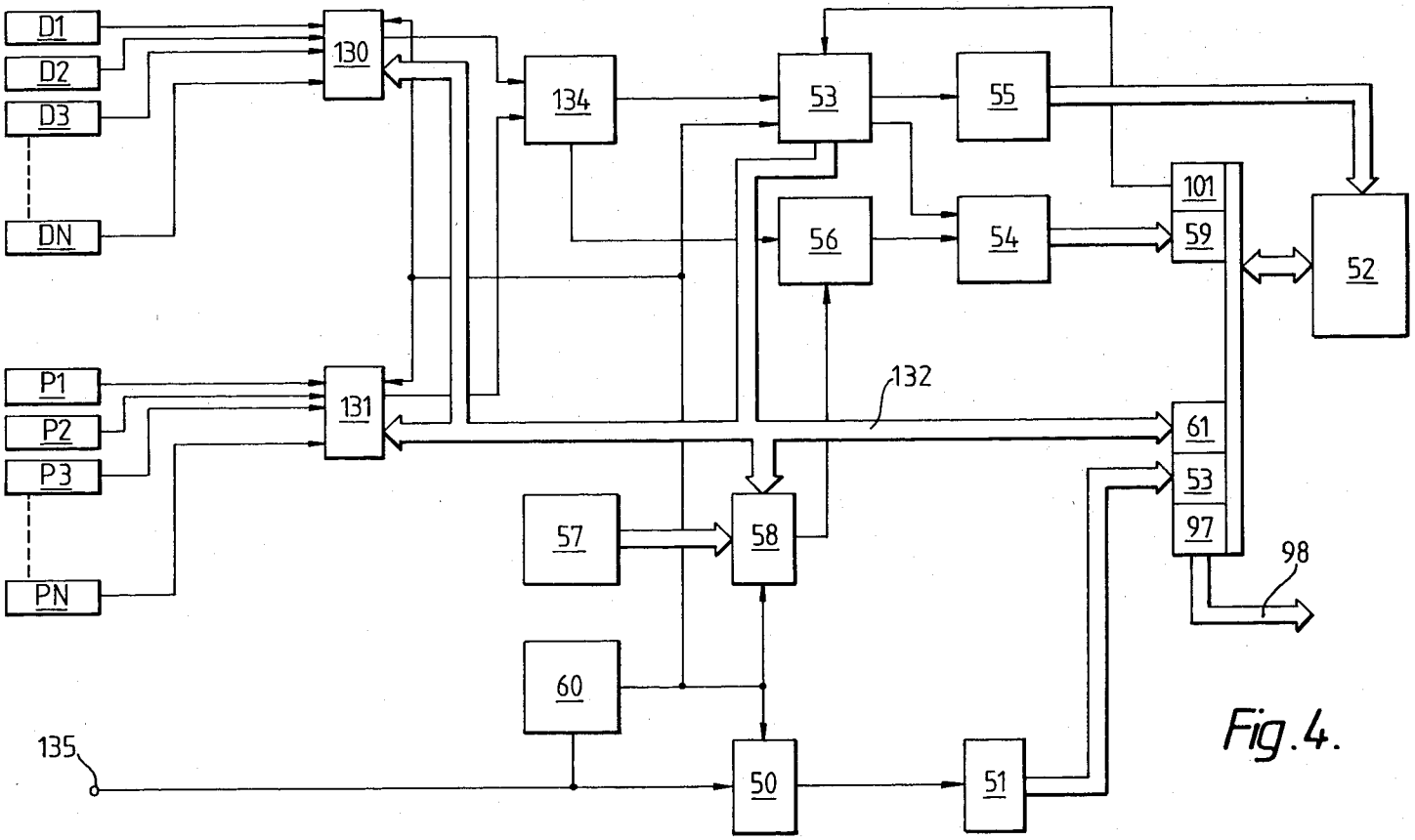
FIG. 4 is a block diagram of an alternative digital circuit for use with FIG. 1.

A block diagram of a digital circuit suitable for processing the outputs from a plurality of transducer combinations is shown in FIG. 4. Components in FIG. 4 which have equivelent components in FIG. 3 are given the same reference numerals plus one hundred. In this circuit a series of pulses are generated, the number of which is proportional to the interval T1. This number is applied to a processing means (in code form) which compares said number with a similar coded representation of the machine speed.

The voltage feed-back signal is applied via input 135 to a bias circuit 50 where it is biased by an initially determined amount to give a single output. This output is applied to an analogue-to-digital convertor 51 which provides a parallel digital code to a microprocessor 52 (via a port 53) indicative of the machine speed.

The output from the logic function circuit 134 is applied to the channel select circuit 53 which applies a channel code on the channel select bus 132, a reset signal to a counter 54, and a signal to an interrupt circuit 55. The logic circuit 134 also supplies an enabling input to a voltage-to-frequency convertor 56 which has an input terminal to which a voltage is applied so that, when enabled, a series of pulses are generated at a frequency proportional to said input voltage. The voltage-to-frequency convertor 56 is enabled during the interval T1 and the pulses generated are applied to the input of the counter 54. The frequency of the pulses generated by the voltage-to-frequency convertor 56 is determined by a frequency control circuit 57, the output of which is applied to the input of the voltage-to-frequency convertor 56 via a frequency control multiplexer 58. The multiplexer 58 is controlled by the channel select bus 132, allowing independently scaled input voltages for each channel to be applied to the input of the voltage-to-frequency convertor 56. The counter 54 counts the pulses generated by the voltage-to-frequency convertor over the interval T1 and at the end of said interval the output from the counter 54 is applied to the microprocessor 52 via a port 59. Before the next transducer pair may be monitored the counter must receive a reset signal from the channel select circuit 53, and the microprocessor must receive an interrupt signal from the interrupt circuit 90 to initiate the required program routine.

In operation the voltage feed-back signal is applied to a speed threshold detector 60 which disables the operation of the channel select multiplexers 130 and 131, the channel select circuit 53, the frequency control multiplexer 58 and the bias circuit 50 when the operating speed is below a threshold level. When the threshold speed is reached the channel select circuit 53 is enabled, the first channel code is applied via the channel select bus 132 to the channel select multiplexers 130 and 131 and the counter 54 is reset. The resulting output from the logic circuit 134 is applied to the channel select circuit 53 which, on detecting the leading edge of the interval T1, applies a signal to the interrupt circuit 55. While the interrupt circuit 53 applies an interrupt signal to the microprocessor 52, the logic function circuit 134 also applies a signal to enable the voltage-to-frequency convertor 56. The voltage-to-frequency convertor generates pulses over the interval T1 at the appropriate frequency selected by the frequency control multiplexer 58. The pulses generated by the voltage-to-frequency convertor are continuously counted by the counter 54 while the microprocessor responds to the interrupt signal.

In response to the interrupt signal, on the rising edge of interval T1, the microprocessor 52 reads the speed of the machine via the bias circuit 50, the analogue-to-digital convertor 51 and port 53, and stores the value so obtained. The microprocessor 52 then similarly reads the channel code from the channel select bus 132 via a port 61, again storing the value so obtained. The time taken for these operations to be carried out by the processor 96 is much shorter than the interval T1 and therefore the processor 96 must wait for a second interrupt.

The second interrupt is generated from a signal applied by the channel select circuit 53 on the falling edge of interval T1. In response to this second interrupt signal the processor reads and stores the output from the counter 54 via a port 59. The microprocessor then reads the speed of the machine again via port 53 and compares this reading with that obtained in response to the previous interrupt at the beginning of the interval T1. If the two speed readings are equal, which may be assumed to indicate stable machine speed over the interval T1, the microprocessor 52 compares the machine speed with the output from the counter 54, obtained at the end of interval T1, and produces an output via a port 62 indicative of the extent of wear.

If the two speed readings differ the processor sets up an internal count for the channel concerned which is increased each time an unsatisfactory speed reading is obtained. After increasing this count the processor waits for a subsequent interrupt signal to initiate processing of the next channel in the sequence.

The machine characteristics determine the number of machine cycles within which the speed should stabilise. The internal count set up by the processor is increased until a preset number of cycles is exceeded, in which case the processor produces a fault signal so that appropriate action may be carried out. When two equal speed readings are obtained the count for that particular channel is reset.

The two circuits described with reference to FIGS. 3 and 4 utilise a machine speed feed-back signal as a reference by which a signal representing the duration of T1 is compared. An alternative approach is to derive signals representing the duration of the intervals T1 and T2, and to deduce the quotient of these intervals which is indicative of the wear present in the associated mechanism, and independent of the absolute speed of the machine. The quotient T1/T2 (in the form of an analogue electrical signal or a digital representation of such a signal) is compared with a predetermined reference, representing a threshold of wear, and an ouptut is produced if this threshold is exceeded.

We claim:

1. A method of monitoring wear associated with a first cyclically moving part in a machine comprising a plurality of moving parts and which operates in a succession of cycles, said method comprising the steps of generating a first signal at a predetermined position and direction of movement of said moving part; generating a second signal at a predetermined cyclic position in each machine cycle; producing a third signal indicative of the time interval between the first signal and the second signal; and processing the third signal, including forming a comparison with a reference signal to determine the extent of wear associated with the first moving part.

2. A method according to claim 1 in which the first signal and the second signal are transitions between two possible states.

3. A method according to claim 1 in which the reference signal varies inversely with the speed of the machine and the third signal is directly compared with said reference signal.

4. A method according to claim 1 in which a quotient is formed between the third signal and a complement of the third signal and said quotient is compared with the reference signal which is pre-set and does not vary with the speed of the machine.

5. A method according to claim 1 in which the third signal is an analogue signal and the amplitude of said analogue signal increases linearly over said time interval.

6. A method according to claim 1 including generating a series of pulses in which the third signal is indicative of a count of said pulses generated over said time interval.

7. A method according to claim 1 in which the first cyclically moving part co-operates with a second cyclically moving part and the second signal is generated at a predetermined position of said second moving part.

8. In a machine comprising a plurality of moving parts and which operates in a succession of cycles, apparatus for monitoring wear associated with a first cyclically moving part, comprising a device for generating a first signal at a predetermined position and direction of movement of said moving part; a device for generating a second signal at a predetermined cyclic position in each machine cycle; means for producing a third signal indicative of the interval of time between the first signal and the second signal; and processing means including means for forming a comparison with a reference signal to determine the extent of wear associated with the first moving part.

9. Apparatus according to claim 8 in which each of said devices produces a signal by means of an output which switches between two possible states at said predetermined positions of the first moving part or the machine cycle respectively.

10. Apparatus according to claim 8 including means for directly comparing the third signal with the reference signal and means for varying the reference signal inversely with the speed of the machine.

11. Apparatus according to claim 8 including means for pre-setting the reference signal independently of the machine speed; means for forming a quotient between the third signal and a complement of the third signal; and means for comparing said quotient with said reference signal.

12. Apparatus according to claim 8 in which the third signal is an analogue signal including means for linearly increasing said analogue signal over said interval of time.

13. Apparatus according to claim 8 including means for generating a series of pulses in which the third signal is indicative of a count of said pulses generated over said interval.

14. Apparatus according to claim 8 including a second cyclically moving part which co-operates with the first moving part; and a device for generating said second signal at a predetermined position of said 15. Apparatus according to claim 14 in which the device for generating the first signal and the device for generating the second signal each consist of a light emitter and a light detector arranged so that said detector receives light from said emitter at predertimed positions of the respective moving parts.

16. Apparatus according to claim 8 wherein said machine is a cigarette packaging machine, said first cyclically moving part is a plunger for transferring a cigarette bundle from an arbor drum to a drying drum, said apparatus for monitoring wear is adapted to monitor wear associated with said plunger, said device for generating a first signal is adapted to generate a first signal indicative of the position of said plunger, said device for generating a second signal is adapted to generate a second signal indicative of the position of said arbor drum, and said processing means includes means for forming a comparison with a reference signal to determine the extent of wear associated with said plunger.

17. In at least one machine comprising a plurality of moving parts, apparatus for monitoring wear associated with a plurality of first moving parts, comprising a plurality of devices in which each of the first moving parts has a device for generating a first signal at a predetermined position and direction of movement of the respective moving part, and a device for generating a second signal at a predetermined cyclic position in each machine cycle; a first multiplexer for sequentially selecting said first signals; means for producing a third signal indicative of the interval of time between the selected first signal and the second signal; and processing means including means for forming a comparison with a reference signal to sequentially determine the extent of wear associated with each of the first moving parts.

18. Apparatus according to claim 17 including a plurality of devices for producing a separate second signal for each of the first signals; and a second multiplexer for selecting the second signal associated with the selected first signal.

19. In a machine for packaging cigarettes including a plunger for transferring a cigarette bundle from an arbor drum to a drying drum, apparatus for monitoring wear associated with a plunger mechanism, comprising a device for generating a first signal indicative of the position of said plunger; a device for generating a second signal indicative of the position of said arbor drum; means for producing a third signal indicative of the interval of time between the first signal and the second signal; and processing means including means for forming a comparison with a reference signal to determine the extent of wear associated with the first moving part.

* * * * *